United States Patent [19]

Bachmann et al.

[11] 4,349,057

[45] Sep. 14, 1982

[54] CUTTING BLADE ASSEMBLY FOR A POWER PLANER

[75] Inventors: Rainer Bachmann, Hohenstein; Helmut Ulm, Limburg, both of Fed. Rep. of Germany

[73] Assignee: Black & Decker Inc., Newark, Del.

[21] Appl. No.: 160,584

[22] Filed: Jun. 18, 1980

[51] Int. Cl.[3] ..... B27G 13/00

[52] U.S. Cl. ..... 144/230

[58] Field of Search ..... 145/4, 4.1; 144/230

[56] References Cited

U.S. PATENT DOCUMENTS

| | | | |
|---|---|---|---|
| 631,542 | 8/1899 | Ihle | 144/230 |
| 1,190,197 | 7/1916 | Shimer . | |
| 1,305,650 | 6/1919 | Heggen | 144/230 |
| 1,980,056 | 11/1934 | Hedeby | 145/4 |
| 3,270,968 | 9/1966 | Hess et al. | 144/230 |
| 3,854,511 | 12/1974 | Maier | 144/230 |
| 3,866,844 | 2/1975 | Montgomery | 144/230 |
| 4,068,694 | 1/1978 | Schmidt et al. | 144/230 |
| 4,194,545 | 3/1980 | Kostermeier | 144/230 |

FOREIGN PATENT DOCUMENTS

| | | | |
|---|---|---|---|
| 314806 | 4/1974 | Australia . | |
| 737211 | 5/1980 | Bulgaria | 144/230 |
| 2159033 | 6/1973 | Fed. Rep. of Germany | 144/230 |
| 2344310 | 5/1975 | Fed. Rep. of Germany . | |
| 2405000 | 8/1975 | Fed. Rep. of Germany | 144/230 |
| 7602409 | 12/1976 | Fed. Rep. of Germany . | |
| 2751903 | 5/1979 | Fed. Rep. of Germany | 144/230 |
| 2736612 | 12/1979 | Fed. Rep. of Germany . | |
| 8006414 | 6/1980 | Fed. Rep. of Germany . | |
| 990578 | 9/1951 | France | 144/230 |
| 2306053 | 10/1976 | France | 144/230 |
| 32852 | 11/1964 | German Democratic Rep. . | |
| 550077 | 12/1942 | United Kingdom | 144/230 |

OTHER PUBLICATIONS

Holz-Zentralblatt, Band 104, No, 12, Jan. 1978, Stuttgart "Spannkeil für Elektro-Handhobel", p. 175, FIGS. 1 to 4.

*Primary Examiner*—Jimmy C. Peters
*Assistant Examiner*—J. T. Zatarga
*Attorney, Agent, or Firm*—Walter Ottesen; Edward D. Murphy; Harold Weinstein

[57] ABSTRACT

The invention is directed to a cutting blade assembly (24) for a rotary cutter head (18) of a power planer tool (10). The blade assembly includes a pressure piece (36), and a blade carrier (60) which is mated with the pressure piece to define a blade slot (68) in which a cutting blade (70) is removably secured. The blade carrier (60) is fixed against movement relative to the pressure piece (36) by way of a dove-tail connection (46, 62) along the mating surfaces of the two pieces. The cutting blade (70) is fixed in elevation within the blade slot (68) by a projection (66) on the blade carrier (60) engaging a recess (72) on a side of the blade between its cutting edges.

9 Claims, 9 Drawing Figures

CUTTING BLADE ASSEMBLY FOR A POWER PLANER

BACKGROUND AND SUMMARY OF THE INVENTION

The present invention relates to portable power planers and in particular to an improved cutting blade assembly for a power planer. In general, portable power planers comprise a motor driven rotary cutter head having one or more removable cutting blade assemblies disposed thereon which are adapted to engage and perform a cutting operation upon the surface of a workpiece as the cutter head rotates. The cutting blade assemblies for such tools are adapted to be installed on the cutter head by inserting them into recesses located circumferentially about the cutter head. In one form, the cutting blade assemblies are secured to the cutter head by directly clamping the cutting assemblies to the cutter head with a plurality of threaded fasteners. In another form, complementary shaped recesses are formed in the cutter head and the cutting blade assemblies secured therein by retracting a plurality of bolts from the blade assembly until they contact the opposite surface of the recess and thereby exert a clamping force on the blade assembly.

Blade assemblies as described above generally fall into two categories: a two-piece assembly, comprised of a relatively large cutting blade fastened to a pressure piece or backing, and a three-piece assembly, comprised of a pressure piece, a blade carrier, and a relatively small cutting blade. The pressure piece and blade carrier of the three-piece assembly comprise distinct pieces which are typically loosely fastened or fitted together. For example, one known prior art design utilizes a pressure piece having several projections along its mating surface which are designed to be received within complementary shaped recesses in the mating surface of the blade carrier to enable the pieces to be properly located with respect to each other. The mating surfaces of these two pieces define a slot in which the cutting blade is received.

The known types of cutting blade assemblies described above possess certain advantages and disadvantages. Assemblies of the two-piece type possess the advantage of having a cutting blade which is positively fixed relative to the pressure piece. This feature enables a fixed blade elevation and greatly reduces the possibility of blade ejection if the fasteners retaining the assembly to the cutter head happen to loosen during operation. On the other hand, the two-piece blade assembly possesses the disadvantage of requiring a relatively large and hence costly cutting blade in order to provide a sufficient working surface to enable the blade to be fastened to the pressure piece. Moreover, the changing of cutting blades with such assemblies can be tedious and somewhat time consuming.

The three-piece blade assemblies of the type described above eliminate the need of a separate blade fastener and require a much smaller cutting blade, resulting in an attendant cost savings. However, such assemblies also possess certain disadvantages. In particular, if the clamping bolts of these assemblies should loosen during operation of the tool, it is possible for the pressure piece and the blade carrier to pivot relative to each other, thereby permitting movement of the cutting blade. In other words, since the known types of three-piece cutting blade assemblies all rely exclusively on the clamping force that is exerted between the pressure piece and the blade carrier to secure the cutting blade, it is possible for the blade to be ejected during operation if the clamping bolts should loosen. Moreover, this situation can become aggravated by the wedging and accumulation of wood chips between the blade and the pressure piece. In addition, as none of the pieces of such three-piece assemblies is positively fixed relative to the rest of the assembly prior to the imposition of a clamping force to the assembly, it is sometimes necessary to go through an inconvenient and often tedious procedure of aligning and realigning the mating surfaces of the pressure piece and blade carrier in order to adequately define a proper blade receiving entity and nesting slot when reversing or replacing cutting blades, or otherwise servicing the assembly.

It is therefore an object of the present invention to provide a three-piece cutting blade assembly for installation in a rotary cutter head of a power planer which is adapted to be completely assembled into a single unit prior to insertion in a rotary cutter head.

In addition, it is another object of the present invention to provide a three-piece cutting blade assembly wherein the blade carrier and pressure piece are tightly secured together so as to positively retain the blade therebetween even absent the clamping force exerted on the assembly when installed in the cutter head to thereby preclude the possibility of blade ejection during operation of the tool.

It is a further object of the present invention to provide such an assembly wherein the cutting blade is relatively small and is positively fixed within the assembly without the need for a separate fastener.

Also, it is an object of the present invention to provide such an assembly which enables the assembly to be easily serviced, as well as the cutting blades to be simply and efficiently reversed and replaced.

Briefly, the cutting blade assembly according to the present invention includes an elongated pressure piece having a dove-tail projection extending longitudinally along a face thereof, and an elongated blade carrier which defines a longitudinally extending recess having a plurality of constrictions at spaced locations therealong which enable the recess to tightly receive the dove-tail projection of the pressure piece. These features enable the pressure piece and the blade carrier to be force fitted together with the blade carrier fixed relative to the pressure piece so that the two pieces constitute a single entity. As so assembled, these two pieces define a longitudinally extending blade receiving slot into which the cutting blade of the assembly is laterally inserted. This slot includes a longitudinally extending projection which is adapted to be received within a groove extending along one face of the cutting blade. This blade groove defines a contact surface which engages the slot projection to enable the blade to be positively fixed relative to the blade carrier/pressure piece combination.

Additional objects and advantages of the present invention will become apparent from a reading of the detailed description of the preferred embodiments which makes reference to the following set of drawings in which:

BRIEF DESCRIPTION OF THE DRAWINGS

FIGS. 8*a* and 8*b* show section and elevation views, respectively, of the blade carrier of the cutting blade assembly.

DETAILED DESCRIPTION OF THE PREFERRED EMBODIMENTS

Figure 1:
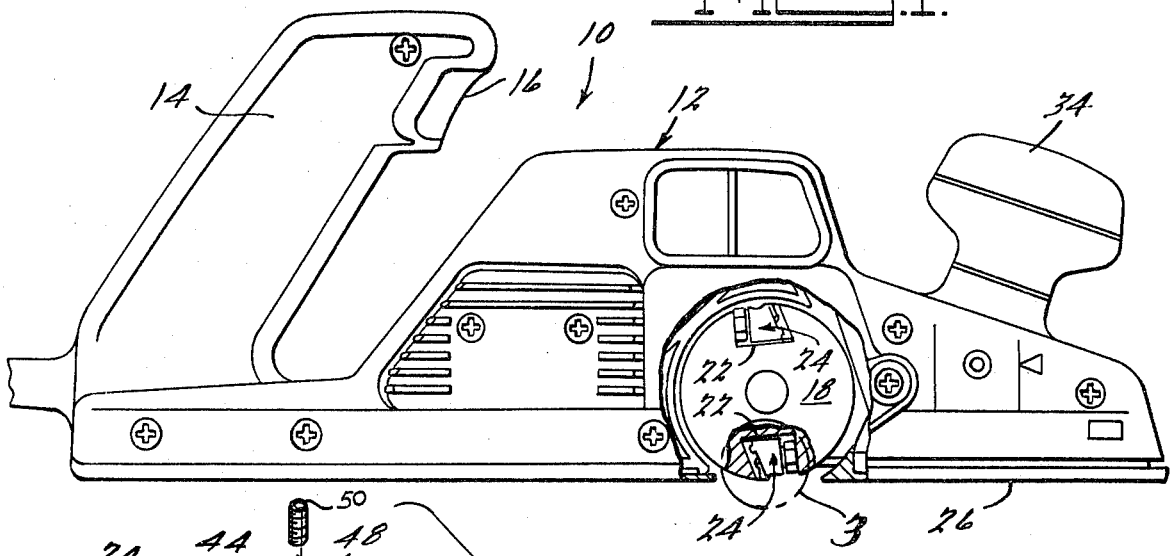
FIG. 1 is an elevational view, partially in section, of a portable power planer tool incorporating an embodiment of a cutting blade assembly in accordance with the present invention, as installed in the cutter head of the tool.
Figure 2:
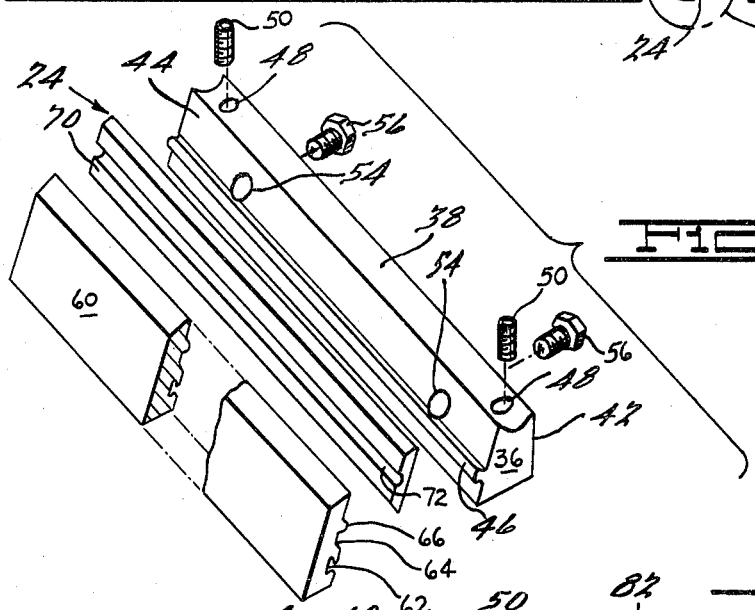
FIG. 2 is an exploded perspective view of one embodiment of a cutting blade assembly according to the present invention.

Referring now to the drawings, a portable power planer tool 10 incorporating a cutting blade assembly according to the teachings of the present invention is shown. The tool 10 includes a generally elongated housing 12 defining an upwardly extending handle 14 incorporating an on/off trigger switch 16. Disposed within the housing is a motor (not shown) which is drivingly coupled to a rotary cutter head 18. As shown in FIG. 1, cutter head 18 defines a pair of diametrically opposed axially extending recesses 22. A cutting blade assembly 24 in accordance with the present invention is secured within each of the recesses 22. As can be seen in FIG. 1, the power planer 10 includes an adjustable shoe 26 located forwardly of cutter head 18 on the bottom side of housing 12. Adjustments in the cutting depth of the tool 10 are made by rotating a handle 34, which is operative to change the height of shoe 26 and thereby vary the amount of exposure of blade assemblies 24.

As shown in FIGS. 2 through 5, the blade assembly 24 according to the present invention includes an elongated pressure piece 36 having a first pair of opposite faces 38 and 40 extending longitudinally therealong. Face 38 is of a generally arcuate shape, while face 40 is generally planar. Pressure piece 36 also defines a second pair of longitudinally extending opposite faces 42 and 44. Face 42 is generally planar and extends substantially normally of face 40 while face 44 is substantially inclined such that the intersection of face 44 and face 40 defines an acute angle. As shown in the drawings, face 44 includes a dove-tail projection 46 extending longitudinally along the length of face 44. The purpose of projection 46 will be described more fully hereinafter. Pressure piece 36 contains a pair of threaded bores 48 extending laterally through pressure piece 36 between faces 38 and 40. Each bore 48 is adapted to receive a suitable sized allen head screw 50 therewithin. Pressure piece 36 also contains a second pair of threaded bores 54 extending laterally through pressure piece 36 between faces 42 and 44. Each of these bores 54 is adapted to receive a clamping screw 56.

Figure 3:
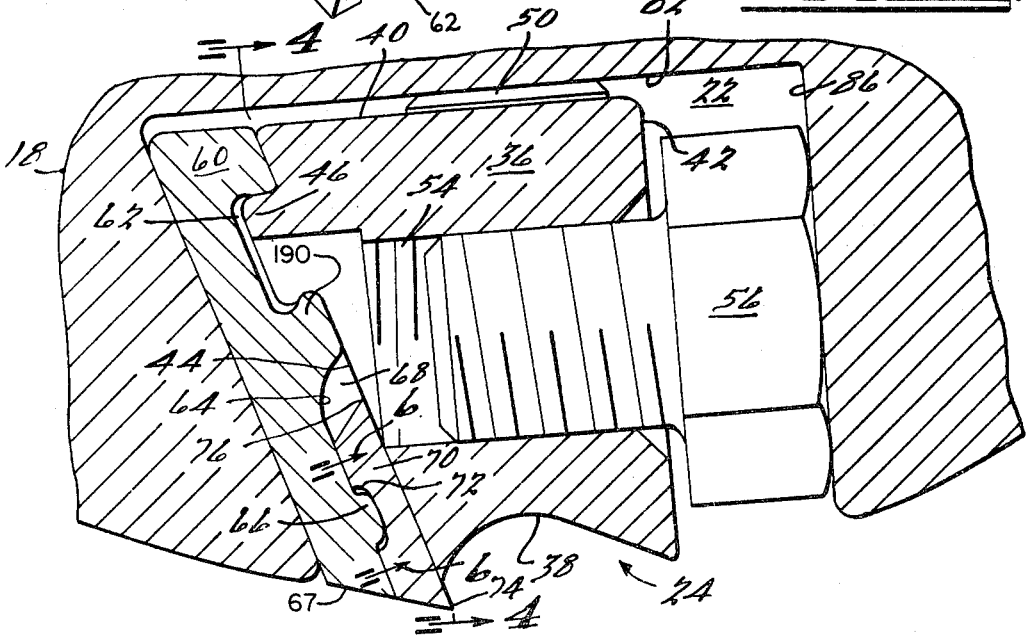
FIG. 3 is a sectional view of the present cutting blade assembly as installed in the cutter head of the power planer tool.
Figure 4:
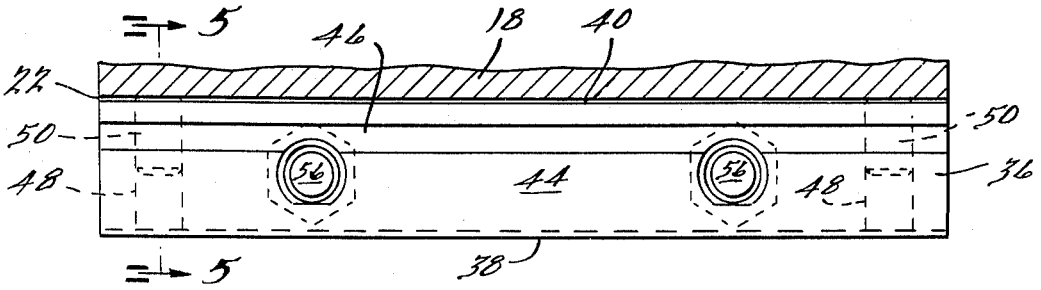
FIG. 4 is an elevational view of a portion of the cutting blade assembly shown in FIG. 3, taken along line 4—4 thereof.
Figure 8A:
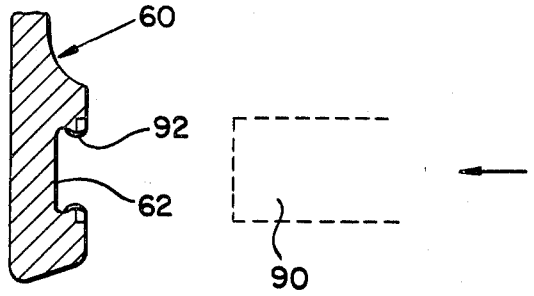
FIG. 8*a* is a section view of the blade carrier taken along line 8*a*—8*a* of FIG. 8*b*.
Figure 8B:
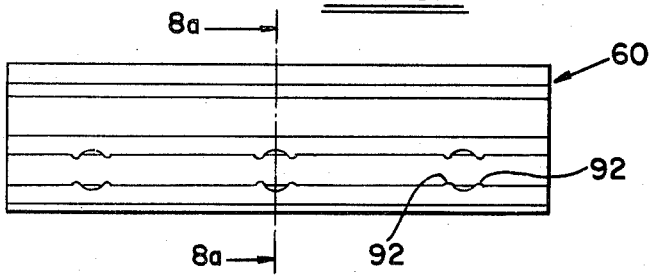
FIG. 8*b* is an elevation view of the blade carrier of FIG. 8*b*.

Cutting blade assembly 24 also includes an elongated blade carrier 60 of a length substantially equal to the length of pressure piece 36. Blade carrier 60 includes a longitudinally extending recess or groove 62, which is of a contour corresponding substantially to that of the dove-tail projection 46 of pressure piece 36. As best shown in FIG. 3, the blade carrier 60 and pressure piece 36 are adapted to be assembled as one unit, with the dove-tail projection 46 being laterally inserted within groove 62 of the blade carrier 60. In this connection, it is to be noted that the blade carrier 60 is pressed or squeezed during manufacture at a plurality of longitudinally spaced locations along its length to effect a slight constriction of groove 62 at these locations. The blade carrier 60 is thereafter force fitted onto pressure piece 36 to effect a mating of dove-tail projection 46 and groove 62. Upon such assembly, the constrictions in groove 62 insure that the blade carrier 60 and pressure piece 36 fit tightly and remain frictionally held together. FIG. 8*a* shows how a stamp 90 shown in phantom can be used to impart the constrictions 92 to the groove 62 of the blade carrier 60. Preferably, three sets of constrictions are imparted to the blade carrier 60 as shown in FIG. 8*b*. FIG. 8*a* is a section view taken through the center constrictions to show how the groove 62 is constricted at this location.

Attention is called to the fact that the blade carrier 60 is tightly held to the pressure piece 36 by the dove-tail connection at substantially the mid-portion of the blade carrier 60 by the leg 190 (see FIG. 3) thereof. More specifically, because the leg 190 is at approximately mid-portion of the blade carrier when viewed in side elevation, the free end 67 of the blade carrier is not too distant from the location whereat the blade carrier is held to the pressure piece 36. The blade carrier 60 is thus positively and tightly fixed relative to pressure piece 36 so that the two pieces constitute a single blade receiving entity, as described more fully hereinafter.

Figure 5:
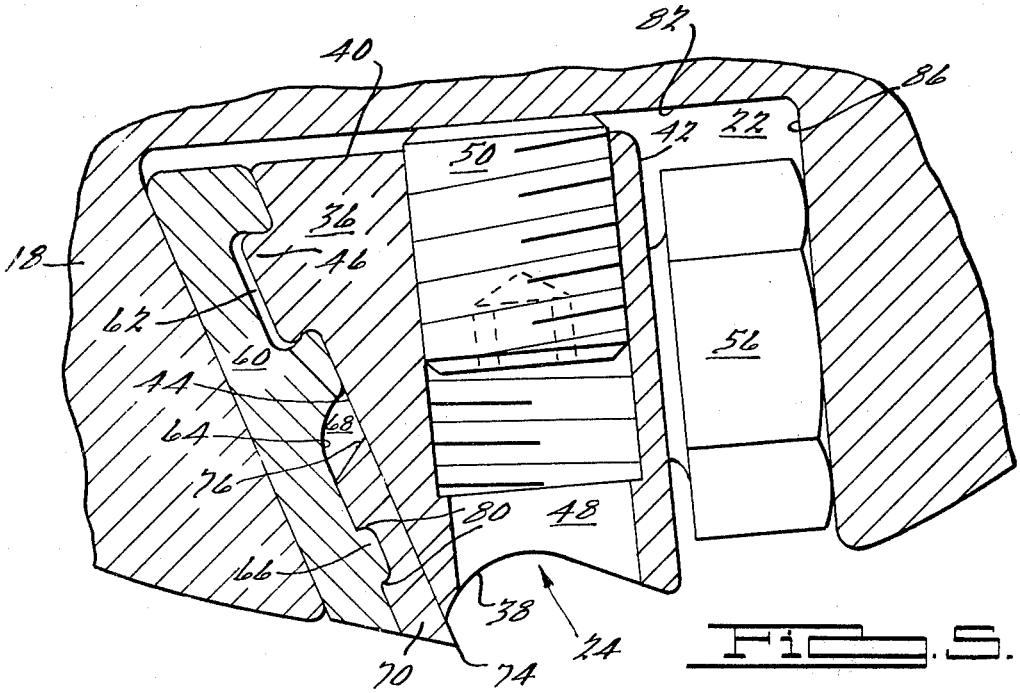
FIG. 5 is a sectional view of the entire cutting blade assembly taken at a line corresponding to the location of line 5—5 of FIG. 4.
Figure 6:
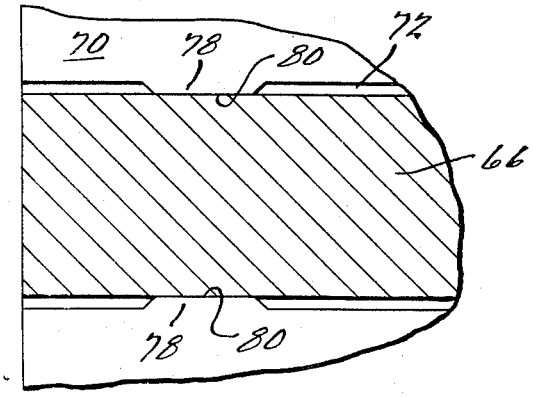
FIG. 6 is a partial sectional view of a portion of the cutting blade assembly shown in FIG. 3, taken along line 6—6 thereof.

With particular reference to FIGS. 3 and 5, blade carrier 60 includes a face 64 having a longitudinally extending projection 66 formed thereon. Upon assembly of blade carrier 60 and pressure piece 36 as described above, face 64 cooperates with a portion of face 44 of pressure piece 36 to define a longitudinally extending blade receiving recess or slot 68 between faces 44 and 64 which is adapted to receive a cutting blade 70. The cutting blade 70 has a width slightly less than the width of slot 68 and includes a longitudinally extending recess or groove 72 of a cross-sectional shape complementary with the projection 66 on blade carrier 60. These features enable the blade 70 to be laterally inserted manually into slot 68 and retained therein by the engagement of projection 66 with groove 72. When so retained, the working edge 74 of cutting blade 70 is exposed a prescribed amount relative to pressure piece 36, while the unexposed edge 76 is freely located within slot 68. The embodiment of cutting blade 70 illustrated in FIGS. 3 and 6 includes a plurality of opposed pairs of inwardly extending projections or nubs 78 at a plurality of longitudinally spaced locations within groove 72 to close tolerances to provide a plurality of contact surfaces 80. These contact surfaces 80 engage projection 66 on blade carrier 60 when the cutting blade 70 is laterally inserted into slot 68 and serve the function of precisely locating and positively fixing the elevation of blade 70 relative to blade carrier 60 and pressure piece 36. The purpose of the projections 78 is to permit the blade 70 to be manufactured from high-grade tungsten steel which otherwise cannot be extruded to close enough tolerances to insure the desired tight fit between groove 72 and projection 66 in blade carrier 60.

In order to utilize the blade assembly 24 with the tool 10, the pressure piece 36, including allen head screws 50 and clamping screws 56, is assembled with blade carrier 60 and cutting blade 70 as described above, and the complete blade assembly 24 is axially inserted into one of the recesses 22 of the cutter head 18 as shown. The entire assembly 24 is elevationally adjusted relative to the outer surface of cutter head 18 by adjusting allen head screws 50 against the bight portion 82 of recess 22. The cutting blade assembly 24 is thereafter clampingly secured within recess 22 by retracting clamping bolts 56 away from face 42 of pressure piece 36 and against wall 86 of recess 22. This clamping action causes the slot 68 to be closed sufficiently to tightly hold the blade 70 between face 64 of blade carrier 60 and face 44 of pressure piece 36. Significant, however, it will be appreciated that the presence of this clamping force is not being exclusively relied upon to prevent radial ejection of the blade 70 during operation of the tool. Rather, even if bolts 56 should loosen during normal operation, the tight dove-tail engagement between blade carrier 60 and pressure piece 36 will prevent the blade carrier 60 from pivoting away sufficiently from pressure piece 36 to allow the blade 70 to eject.

Accordingly, it will be appreciated that with the cutting blade assembly 24 of the present invention, the blade carrier 60 is positively fixed relative to pressure piece 36 by way of projection 46 and groove 62. Moreover, blade 70 is positively fixed with respect to blade carrier 60, and therefore with respect to pressure piece 36, by the above-described engagement of projection 66 and contact surfaces 80 of blade groove 72. These features substantially eliminate the possibility of relative movement of the three pieces of the assembly in the event the clamping bolts 56 should loosen during tool operation, and thereby provide an improved blade assembly wherein ejection of the blade is impossible and wherein the possibility of wood chip wedging and uneven cutting are substantially reduced. These features also serve to provide a three-piece assembly which does not require a separate realignment of pieces when the assembly is removed from the cutter head recess for servicing or reversing or replacing of the cutting blades.

As previously noted, the blade 70 is positively fixed in elevation relative to the surface of cutter head 18 by the engagement of contact surfaces 80 of blade groove 72 with projection 66 on blade carrier 60. This feature eliminates the need to provide a projection in slot 68 to support the unexposed edge 76 of blade 70 in order to properly locate the blade 70 relative to the surface of cutter head 18. As a result, frictional wear of the unexposed blade edge is avoided, along with the attendant reduction of blade life and uneven workpiece cutting upon blade reversal.

Figure 7:
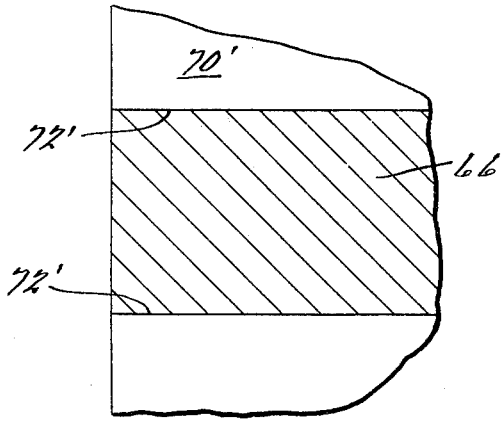
FIG. 7 is a partial sectional view similar to FIG. 6, illustrating another embodiment of a cutting blade assembly in accordance with the present invention.

An alternative embodiment of a cutting blade is shown in FIG. 7 and designated 70'. In this embodiment, blade 70' is manufactured from carbon steel, which enables the groove 72' to be accurately extruded to the desired tolerance to perform the same function as contact surfaces 80 of blade 70 along its entire length.

It is understood that the foregoing description is that of the preferred embodiments of the invention and that various changes and modifications may be made thereto without departing from the spirit and scope of the invention, as defined in the appended claims.

What is claimed is:

1. In a power planer having a motor drivingly coupled to a rotary cutter head for supporting at least one cutting blade assembly comprising an elongated pressure piece, and elongated carrier piece engaged with said pressure piece, and a blade; the improvement wherein:

said pressure piece and said carrier piece have substantially complementary contoured mating surfaces formed thereon which permit said pieces to be jointed only by longitudinally inserting one into the other in the direction of elongation thereof, said pieces when joined being frictionally engaged and rigidly held together by said complementary contoured mating surfaces, and said pieces defining therebetween an elongated slot in which said blade is received and retained.

2. A power planer, comprising:

a rotary cutter head;

a cutting blade assembly releasably supported by said rotary cutter head, said blade assembly comprising an elongated blade carrying portion having a longitudinally extending blade receiving slot and a cutting blade, removably retained within said blade receiving slot for performing a cutting operation;

said blade carrying portion comprising a first piece having an elongated body including a longitudinally extending first mating face, a second piece having an elongated body including a longitudinally extending second mating face, and engagement means formed on said first and second mating faces mutually engaging said first and second mating faces so as to secure said first piece to said second piece; and said engagement means permitting said first and second pieces to be joined only by longitudinally inserting one into the other, said pieces when so joined being frictionally engaged and rigidly held together by said engagement means and constituting a single blade receiving entity.

3. A power planer, comprising:

a rotary cutter head having at least one recess in the periphery thereof;

a cutting blade assembly releasably retained in said recess, said assembly comprising an elongated pressure piece, an elongated carrier piece engaged with said pressure piece, and a blade retained therebetween; and said pressure piece and said carrier piece having substantially complementary contoured mating surfaces formed thereon which permit said two pieces to be joined together only by longitudinally inserting one into the other, said two pieces when joined being frictionally engaged and rigidly held together by said complementary contoured mating surfaces, and said two pieces defining therebetween an elongated slot in which said blade is received and retained.

4. The power planer claimed in claim 3, wherein said mating surfaces of said pressure piece and said carrier piece comprise the complementary halves of a longitudinal dove-tail joint.

5. The power planer claimed in claim 4, wherein:

the complementary shaped halves of said dove-tail joint comprise a dove-tail projection on one mating surface and a complementary shaped groove on the other mating surface; and wherein said groove includes a multiplicity of longitudinally spaced constrictions formed therein to enable a force fitting of said projection within said groove.

6. The power planer claimed in claim 3, wherein one of the faces of said blade and the opposing face of said slot have longitudinally extending substantially complementary contoured mating surfaces formed thereon which positively locate the elevational position of said blade relative to said pressure piece and carrier piece.

7. The power planer claimed in claim 6, wherein said blade had cutting edges on opposite sides thereof and the depth of said slot for receiving said blade is greater than the width of said blade so that the unexposed cutting edge of said blade is unsupported and freely disposed within said blade receiving slot.

8. A power planer, comprising:

a rotary cutter head having at least one axially extending recess in the periphery thereof, and arranged to be drivingly rotated;

a cutting blade assembly releasably retained in said recess, said assembly comprising an elongated pressure piece, an elongated blade carrier engaged with said pressure piece, and an elongated blade retained therebetween;

said pressure piece and said blade carrier having mating surfaces, one of said surfaces comprising a longitudinally extending dove-tail projection and the other of said surfaces comprising a substantially complementary shaped longitudinally extending dove-tail recess;

a plurality of constrictions at longitudinally spaced locations within said dove-tail recess to enable a force fitting of said dove-tail projection longitudinally into said dove-tail recess whereby said pressure piece and said blade carrier are rigidly secured together and constitute a single blade receiving entity; and said pressure piece and said blade carrier defining a longitudinal slot therebetween in which said blade is received longitudinally, said blade being located in said slot by engagement of complementary longitudinally extending mating surfaces of said blade and said slot.

9. A cutting blade assembly for a power planer having a rotary cutting head with at least one axial recess in the periphery thereof, comprising:

an elongated blade;

an elongated blade carrier;

an elongated pressure piece having a plurality of screw threaded bores therein extending transversely from adjacent longitudinal sides thereof and containing two sets of screws, one set for adjusting the elevational position of said assembly in the axial recess of the rotary cutting head, and the other set for securing said assembly in said recess;

said pressure piece and said blade carrier having mating surfaces, one of said surfaces having a longitudinally extending dove-tail projection and the other of said surfaces having a substantially complementary shaped longitudinally extending dove-tail recess;

a plurality of constrictions at longitudinally spaced locations within said dove-tail recess to effect a force fit of said dove-tail projection longitudinally into said dove-tail recess whereby said pressure piece and said blade carrier are rigidly secured together and constitute a single blade receiving entity; and said pressure piece and said blade carrier defining a longitudinal slot therebetween in which said blade is received longitudinally, said blade being located in said slot by engagement of complementary longitudinally extending mating surfaces of said blade and said slot.

* * * * *